US009915045B1

(12) United States Patent
Azizinamini

(10) Patent No.: US 9,915,045 B1
(45) Date of Patent: Mar. 13, 2018

(54) FOLDED STEEL PLATE BRIDGE SYSTEM

(71) Applicant: Atorod Azizinamini, Miramar, FL (US)

(72) Inventor: Atorod Azizinamini, Miramar, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 15/806,869

(22) Filed: Nov. 8, 2017

Related U.S. Application Data

(60) Provisional application No. 62/419,132, filed on Nov. 8, 2016.

(51) Int. Cl.
*E01D 2/00* (2006.01)
*E01D 19/00* (2006.01)
*E01D 2/04* (2006.01)

(52) U.S. Cl.
CPC ..... *E01D 19/00* (2013.01); *E01D 2/04* (2013.01)

(58) Field of Classification Search
CPC ..... E01D 2/04; E01D 19/00
USPC ..... 14/24, 77.1; 52/848
See application file for complete search history.

(56) References Cited

U.S. PATENT DOCUMENTS 1,639,930 A * 8/1927 Louis ..... E04L 37/105 14/14
2,336,622 A * 12/1943 Le Tourneau ..... E01D 15/133 14/74.5
2,854,742 A * 10/1958 Guild ..... E01D 21/08 14/24
2,894,527 A * 7/1959 Riley ..... E01D 18/00 137/236.1
4,080,681 A * 3/1978 Olrik ..... E01D 2/00 14/74.5
7,069,614 B1 * 7/2006 Sivachenko ..... E01D 2/00 14/73
7,367,075 B2 * 5/2008 Kim ..... E01D 19/00 14/73.5
7,627,921 B2 * 12/2009 Azizinamini ..... E01D 2/00 14/74.5
8,752,225 B2 * 6/2014 Meheen ..... E01D 4/00 14/2

* cited by examiner

*Primary Examiner* — Raymond W Addie
(74) *Attorney, Agent, or Firm* — Salwanchik, Lloyd & Eisenschenk

(57) ABSTRACT

Folded plate girders can be connected end to end to form a cambered girder, wherein a connector system including a peripheral connecting flange secures adjacent girders in series at the desired camber arc or angle.

20 Claims, 16 Drawing Sheets

3 FILLER PLATE
3/4" = 1'-0"

FOLDED STEEL PLATE BRIDGE SYSTEM

CROSS-REFERENCE TO A RELATED APPLICATION

This application claims the benefit of U.S. Provisional Application Ser. No. 62/419,132, filed Nov. 8, 2016, the disclosure of which is hereby incorporated by reference in its entirety, including all figures, tables and drawings.

This invention was made with government support under DTRT13-G-UTC41 awarded by U.S. Department of Transportation. The government has certain rights in the invention.

BACKGROUND OF INVENTION

Folded steel plate girders are commonly used in constructing bridge spans. These types of girders are advantageous for short bridge spans of 60 feet or less, which accounts for about half of the almost 700,000 bridges in the United States. Folded steel girders provide a quick, cost-effective system for building new, short span bridges and for repairing existing ones. The folding process forms an open channel in the girder that traverses the length of the bottom side of a folded plate girder. This channel allows for quicker and easier inspection, which can also save costs.

Folded steel plate girders are limited to short span bridges or simple spans. Longer bridges and those intended to support greater weights are designed to have a certain amount of camber. Camber is an obtuse curvature in a long span that helps to absorb weight near the center of the span and increase strength. Because of the method by which folded steel plate girders are manufactured and the final shape of the girders, it is not possible to introduce camber into the girder. This limits the applicability of folded steel plate girders.

BRIEF SUMMARY

The subject invention provides connector systems that facilitate the introduction of camber between the folded plate girders for use across long bridge spans. Currently the maximum length of a Folded Plate Steel Bridge System is limited to the maximum length of available press breaks, which is about 60 ft. Utilizing the unique connecting components and method of the subject invention, folded plate girders can be utilized in simple bridge systems where a single girder is sufficient and, when two or more girders are connected, can be used for any length of continuous bridge systems to cross any span.

A standard folded steel plate girder is fabricated from a single steel plate of uniform thickness that is cold bent along multiple lines using a hydraulic metal press break. The single steel plate is transformed into a tubular trapezoidal-like shape with an open, longitudinal channel between flanges along the length of the wider bottom end. At the top end of the folded steel plate are headed studs to which a concrete deck can be attached.

The folded plates can be cut at a cross section angle, where the top end of the girder extends slightly past the bottom or open end of the girder. This can create an obtuse angle at the bottom end of the folded plate, such that the top end extends past the bottom end. A splice plate can be fixedly attached, such as by welding, to the angled ends and used to bolt the girders together. Alternatively, the splice plate can be welded to girder and fill material can be used to impart an obtuse angle to the shear plate. With either technique, when the girders are bolted together, there is formed an arc between them, relative to the longitudinal length of the connected girder that performs the same function as camber. The addition of a filler plate hear the splice plate and between the bottom flanges of the girder provides additional width to the bottom flange can reduce concentration of stress in the vicinity of the splice plate.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention.

FIG. 2A shows girders with modified end faces and a connector system embodiment of the subject invention attached thereto. FIG. 2B illustrate that two modified girders attached by the connector system have bottom sides that form an obtuse angle.

DETAILED DISCLOSURE

The subject invention pertains to improvements to folded steel plate girders. More specifically, the subject invention provides methods for forming camber between two or more folded plate girders. For literary convenience, a folded plate girder is also referred to herein as a girder.

Figure 1:
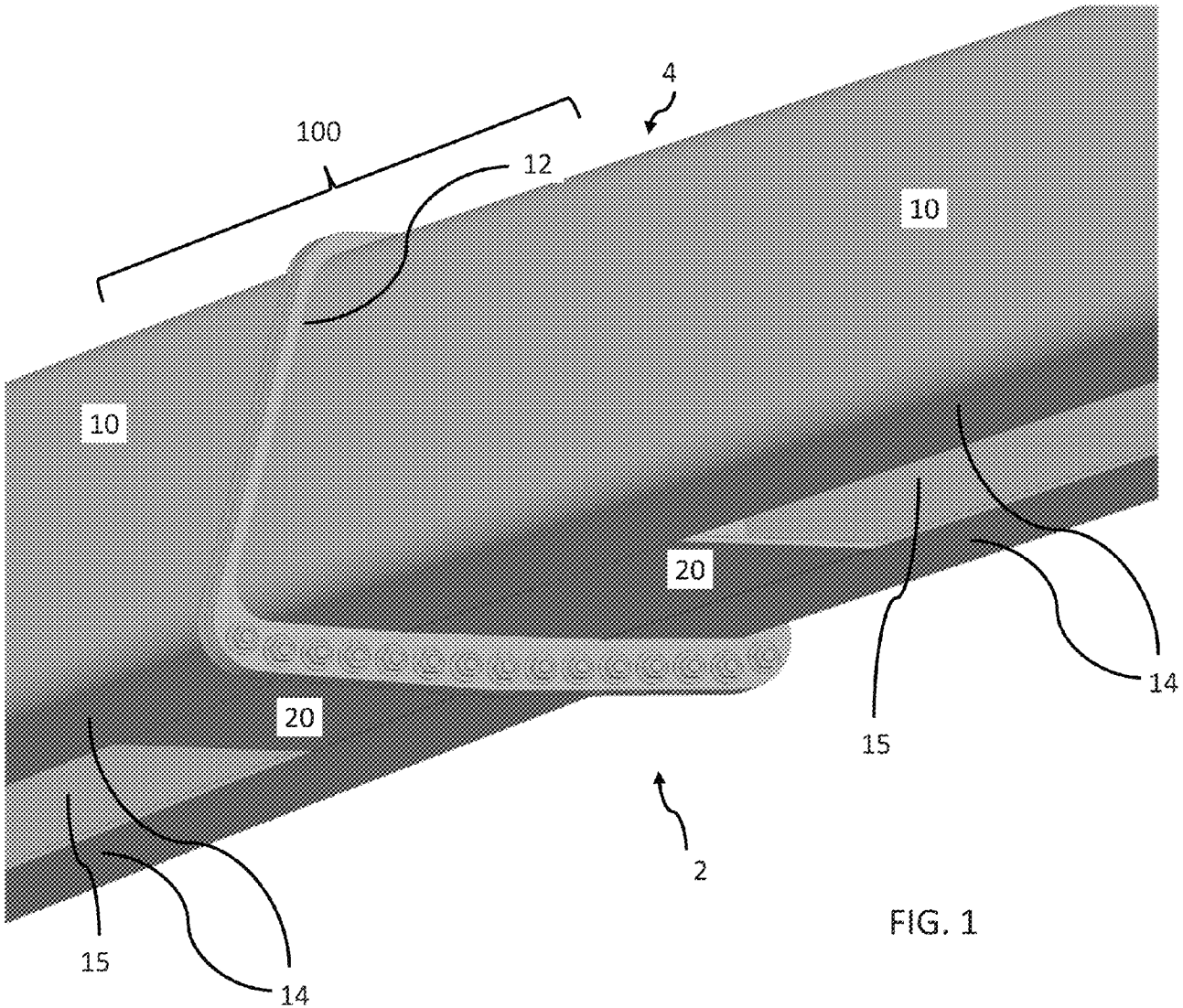
FIG. 1 is an enlarged view of a connector system embodiment of the subject invention.
Figure 2A:
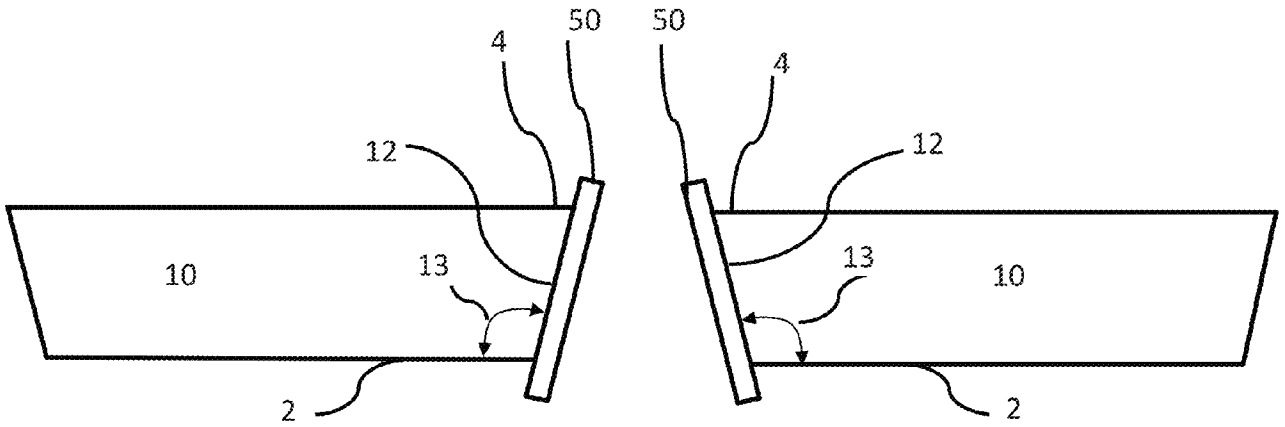
FIGS. 2A and 2B are side elevation views of two folded plate girders.

The ends of a girder 10 can be attached utilizing a connection system 100 that can form an arc or angle 11 between two connected girders, and can reinforce the connection points. The arc formed between two or more girders can perform the same function as camber in absorbing loads. FIG. 1 illustrates one embodiment of the connection system 100. In one embodiment, the end faces 12 of the girders are formed or cut to form an obtuse angle 13 at the bottom side 2, such that the top side 4 of the end face extends past the bottom side 2 of the end face, as shown, for example, in FIG. 2A.

In one embodiment, the arc 11 formed between the bottom ends 2 two connected girders is between about 181° and about 190°. In a further embodiment, the arc 11 formed between two connected girders is between about 181° and about 185°. In more particular embodiment, the arc formed between the bottom sides of two connected girders is between about 181° and about 183°. In a specific embodiment, the arc formed between the bottom sides of two connected girders is about 182°.

Figure 3:
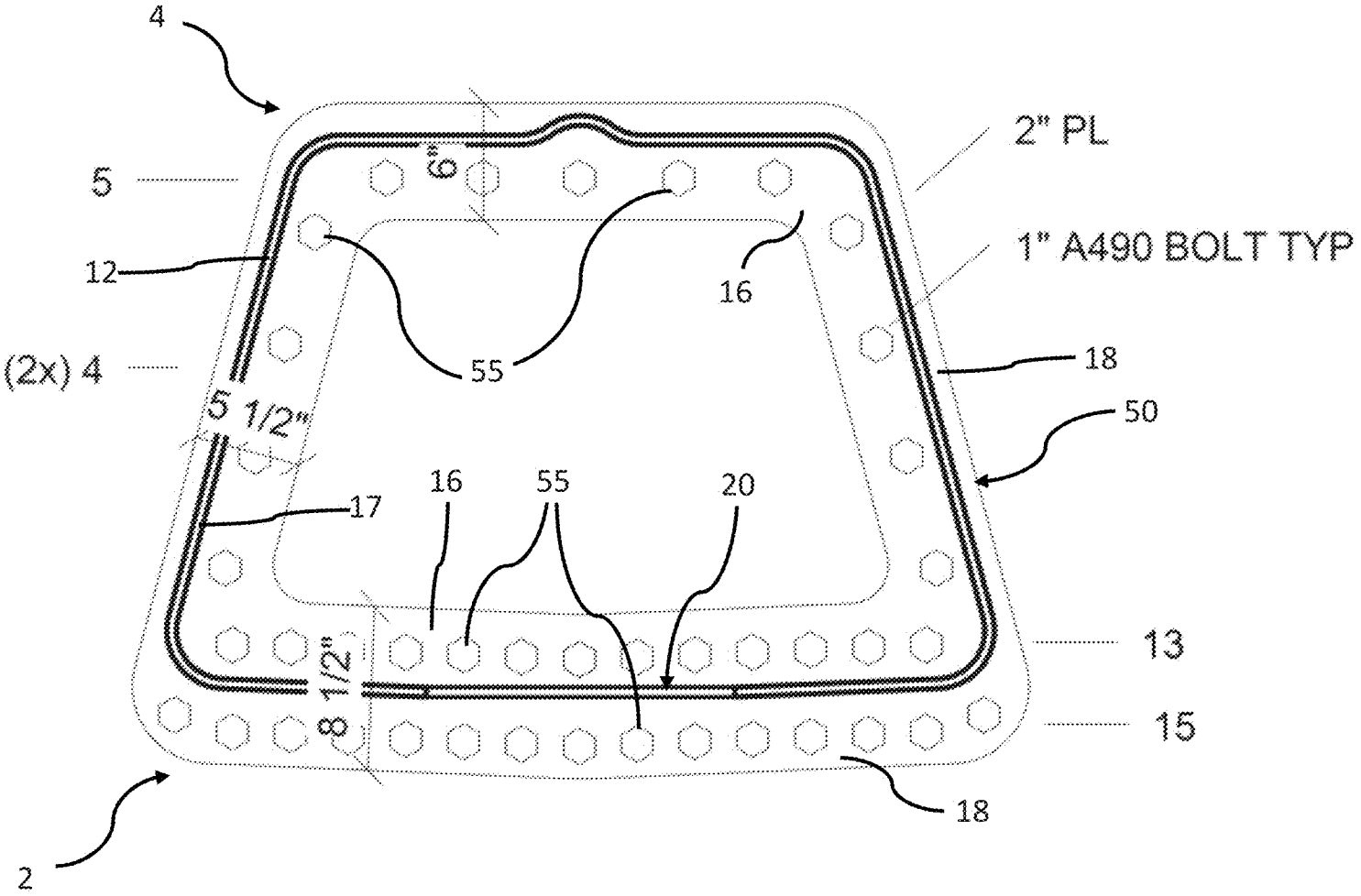
FIG. 3 is a front elevation view of a folded plate girder having an embodiment of a connector system of the subject invention attached thereto.

In a further embodiment, a filler plate 20 is fixedly attached within the girder channel 15 and to the flanges 14 on either side of the channel. The filler plate can have a thickness that is greater than the thickness of the girder 10. In one embodiment, the thickness of the filler plate is between approximately 0.75 inch and approximately 1.0 inch. In a particular embodiment, the thickness of the filler plate is approximately 0.5 inch. The filler plate can be positioned near the end face 12 of the girder, as shown in FIGS. 1 and 3. In one embodiment, the filler plate is welded into the opening and to the flanges on either side.

Figure 2B:
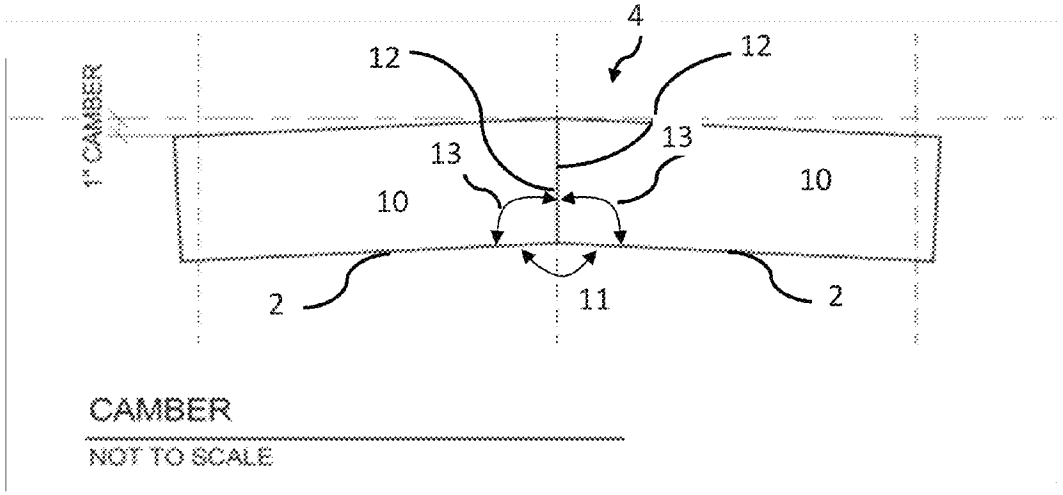

In a further embodiment, a splice plate 50 is fixedly attached against the end face 12 of the girder, as shown in FIGS. 2 and 3. With this embodiment, the splice plate will be positioned at the same angle as the end of the girder, which is shown, for example, in FIG. 2B. In one embodiment, the splice plate is attached so that the end face 12 of the girder is interposed between inside and outside edges of the splice plate. This forms an inside plate portion 16 and an outside plate portion 18, as shown, for example, in FIG. 3. The plate portions can be used to connect splice plates to one another.

Complete joint penetration welds can be used to join the girders and the splice plate. In one embodiment, a complete joint penetration weld is employed to attach at least a portion of a splice plate to a girder. In a further embodiment, a complete joint penetration weld is employed to attach at least a portion of the splice plate to the girder at or about the bottom side. For example, a bottom third of the girder and splice plate can be joined by a complete joint penetration weld. In a further embodiment a double fillet weld can be used to attach at least a portion of the splice plate to the girder. For example, a portion of the splice plate can be attached to the girder at or about the top end with a double fillet weld.

The splice plate can have a plurality of bolt holes 55. The bolt holes can be used to connect the splice plate of one girder to the splice plate of another girder using bolts, such as, for example, 1" A490 bolts. In one embodiment, a plurality of bolt holes is located in the outside plate portion 18, as shown in the example in FIG. 3. In a further embodiment, there are additional bolt holes in the inside plate portion 16, which is also shown in FIG. 3. In a specific embodiment, illustrated in FIG. 3, there is a plurality of bolt holes around the entire inside plate portion 16. In a further specific embodiment, the bottom end 2 of the outside plate portion 18 has a plurality of bolt holes, for additional reinforcement along the camber-formed side. Other bolt hole configurations can be used, as determine by a person of skill in the art.

Figure 4:
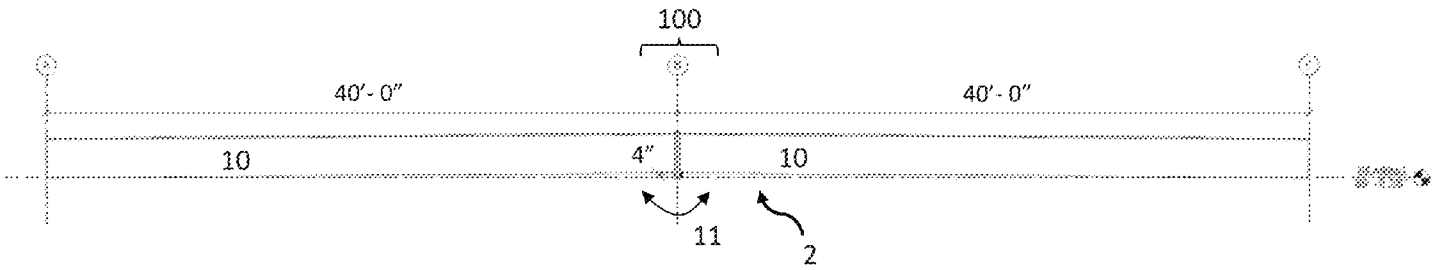
FIG. 4 is a schematic drawing that illustrates the camber formed between two folded plate girders attached using a connector system of the subject invention.
Figure 5:
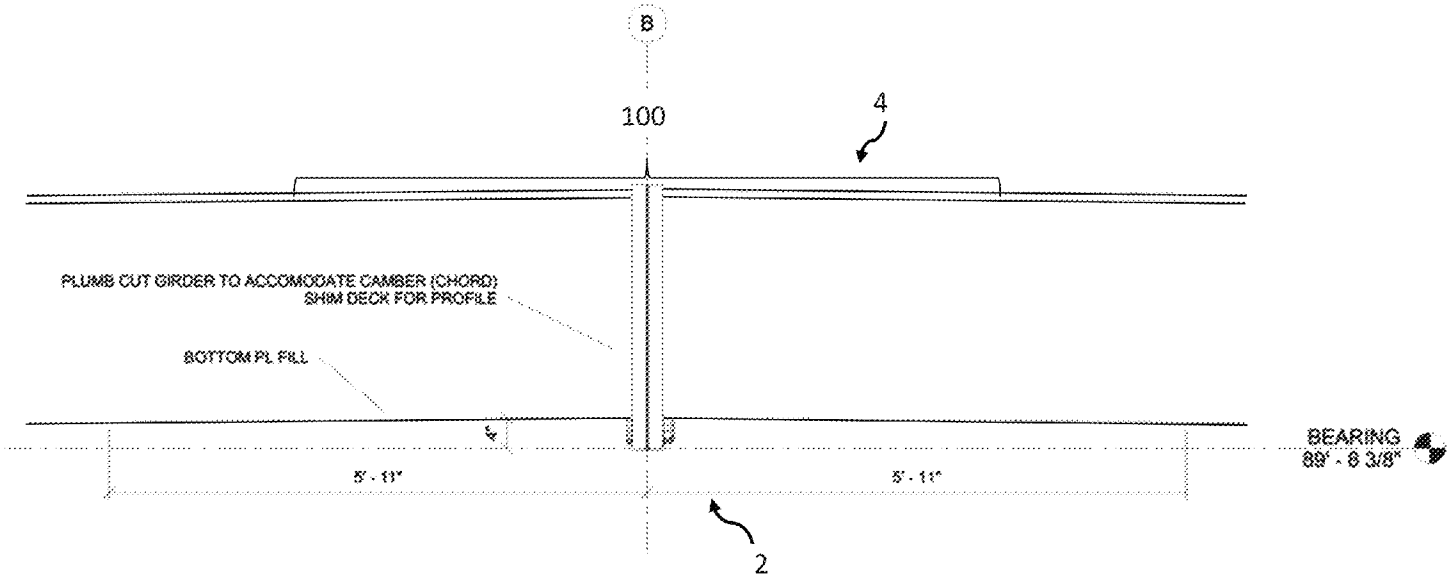
FIG. 5 is a schematic drawing that illustrates two folded plate girders attached with a connector system embodiment of the subject invention.
Figure 6:
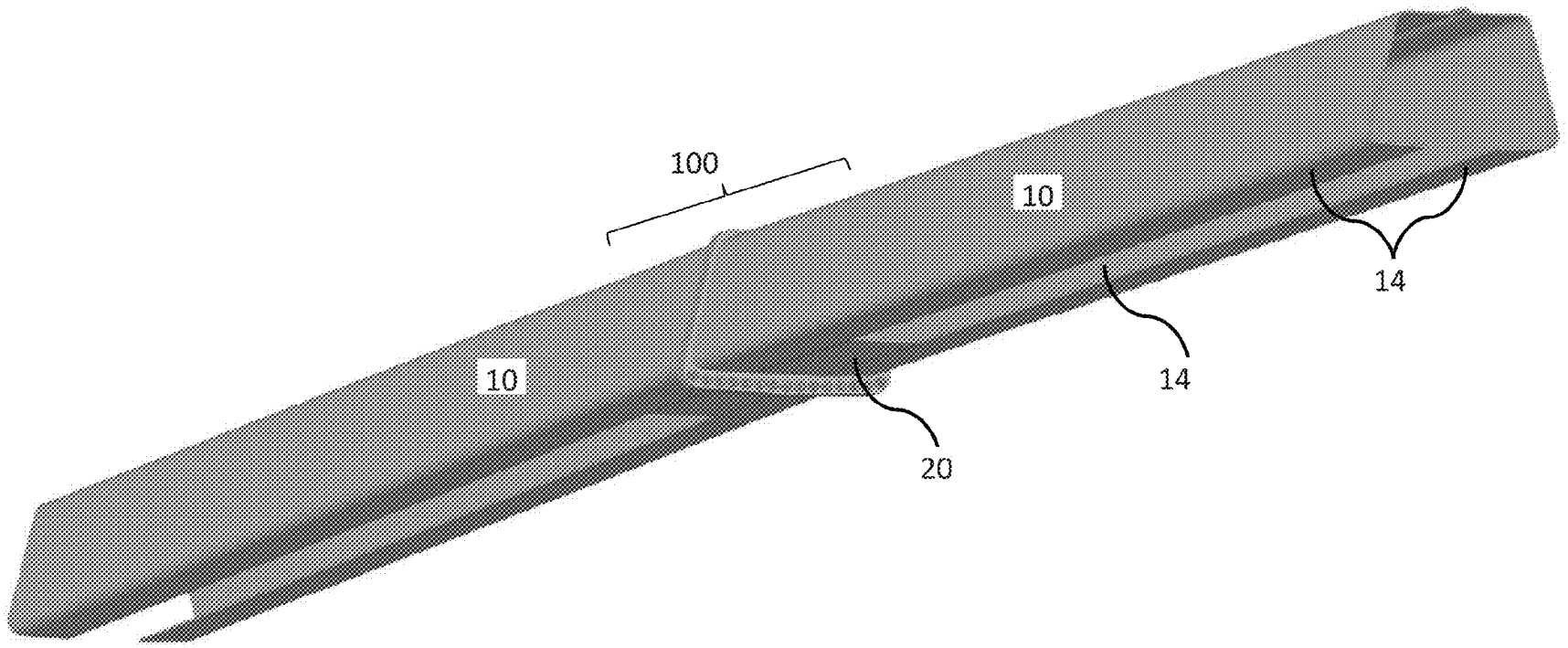
FIG. 6 is an illustration of two folded plate girders attached with a connector system embodiment of the subject invention.

Two girders, each having a filler plate 20 fixed within the channel 15 and a splice plate fixed at the end faces 12, can be joined by connecting their respective splice plates. When joined together, the obtuse angle at the bottom ends 2 imposes an angle between two girders, as shown, by way of example, in FIGS. 4 and 5. This imposed angle provides camber between the two girders. FIGS. 4 and 5 illustrate one example of camber formed between two girders attached by the connector system 100 of the subject invention. FIG. 5 shows another embodiment of the connector system in place and connecting two folded steel girders.

Camber is a deviation from the straightness of an edge. Camber in a girder is the amount of deviation or bend along the length of a girder. Typically, camber is expressed as inches per feet. When two straight girders are joined, according to the subject invention, camber can be a measure of the deviation or bend between the two girders. In one embodiment, the camber between two 40 ft. girders 10 is between approximately 0.5 inch and 2.0 inches. In a further embodiment, the camber between two 40 ft. girders 10 is between approximately 0.75 inch and approximately 1.5 inches. In a specific embodiment, the camber between two 40 ft. girders 10 is approximately 1.0 inch.

In a further embodiment, the end faces 12 of the girders and the filler plate 20 located between the bottom flanges 14 are directed attached, such as by welding, to a splice plate. Advantageously, this allows the splice plate to compensate for fabrication tolerances in the folded girders. It can be beneficial if the bottom flanges of the girders are aligned with each other, so that tension forces along the longitudinal length of connected girders are directly and uniformly distributed. Any offset at the top end can be compensated for by the concrete deck 80 placed over the top end around shear studs (head studs) 85, as shown, for example, in FIGS. 9, 10, 11 and 14. Following is an example that illustrates procedures for practicing the subject invention. This example is provided for the purpose of illustration only and should not be construed as limiting. Thus, any and all variations that become evident as a result of the teachings herein or from the following example is contemplated to be within the scope of the present invention.

Figure 7:
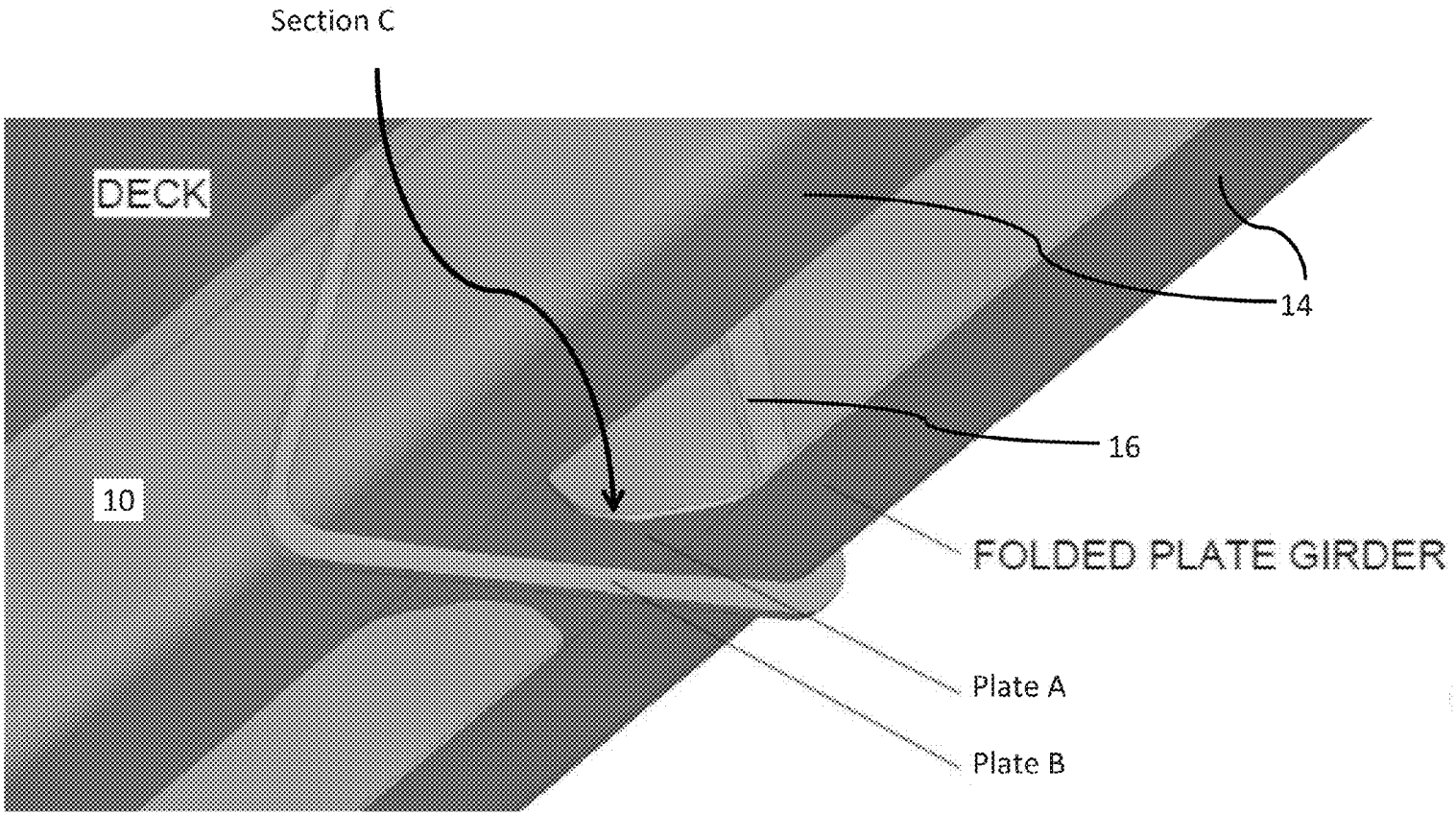
FIG. 7 is an enlarged view of two folded plate girders attached with a connector system embodiment of the subject invention, wherein plate A, plate B and section C are shown.
Figure 8:
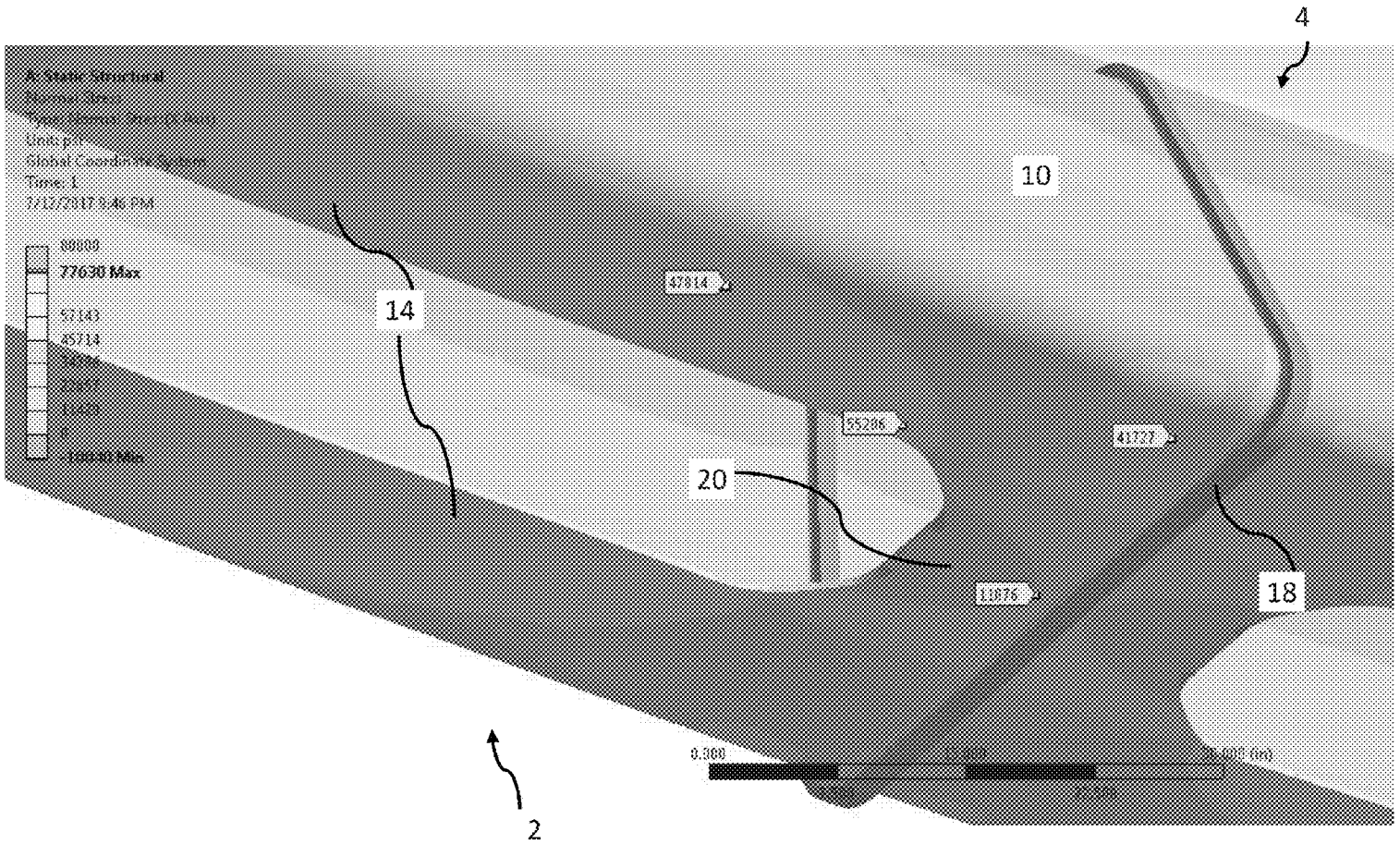
FIG. 8 is an illustration of the distribution of tension forces between two folded plate girders attached by an embodiment of a connection system, according to the subject invention.
Figure 9:
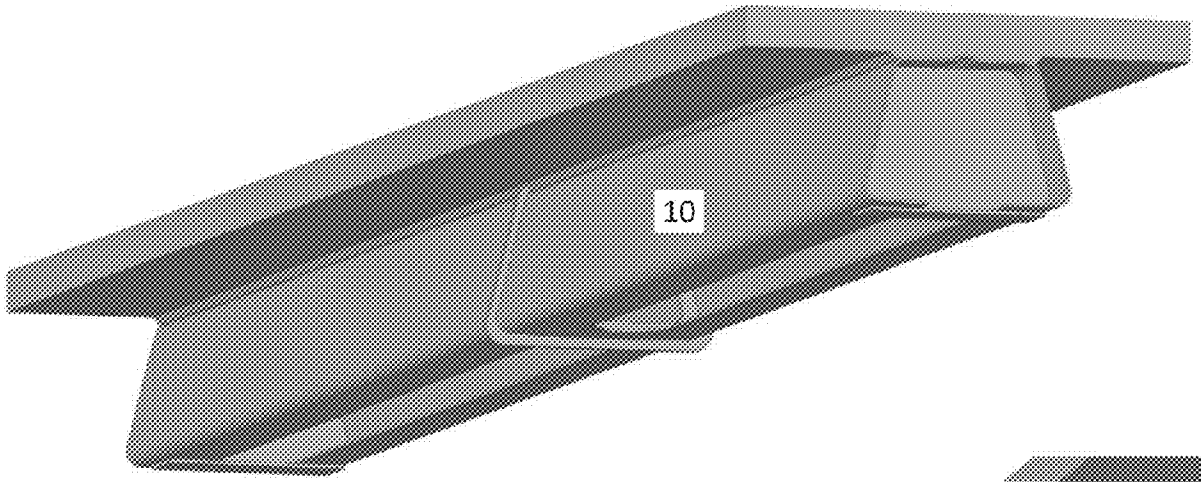
FIG. 9 is an illustration of two folded plate girders attached by an embodiment of a connection system, according to the subject invention, with decking arranged on the top end of the attached girders.
Figure 10:
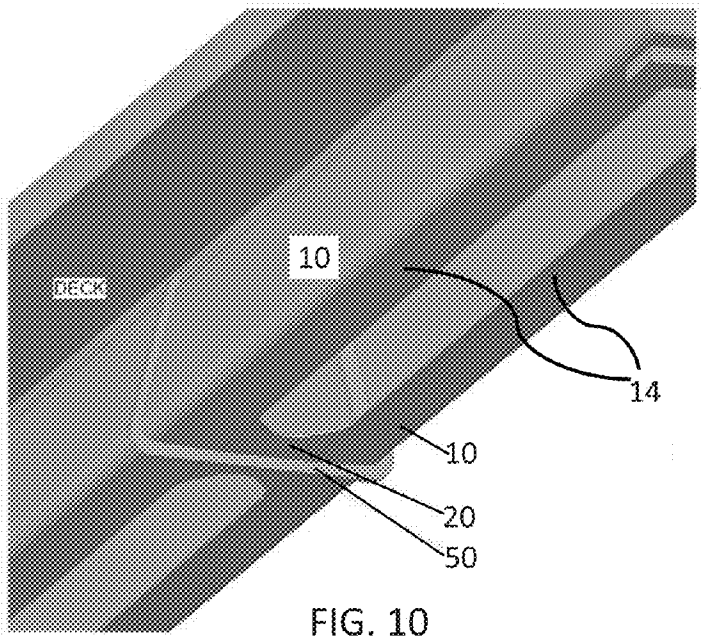
FIG. 10 is an enlarged view of the connection system shown in FIG. 9.
Figure 11:
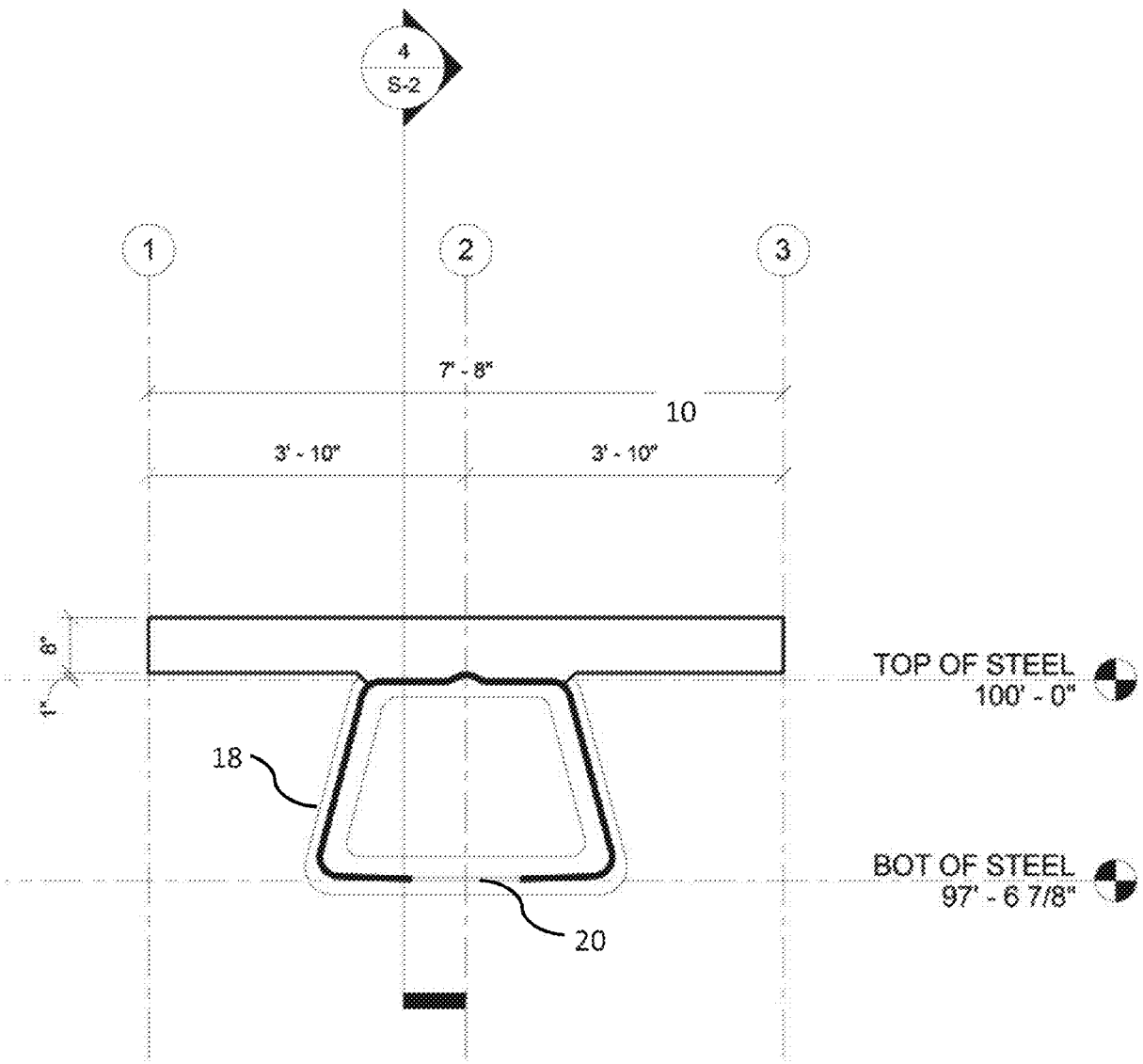
FIG. 11 is a side elevation schematic of a folded plate girder with an attached splice plate and fill plate, according to the subject invention.
Figure 12:
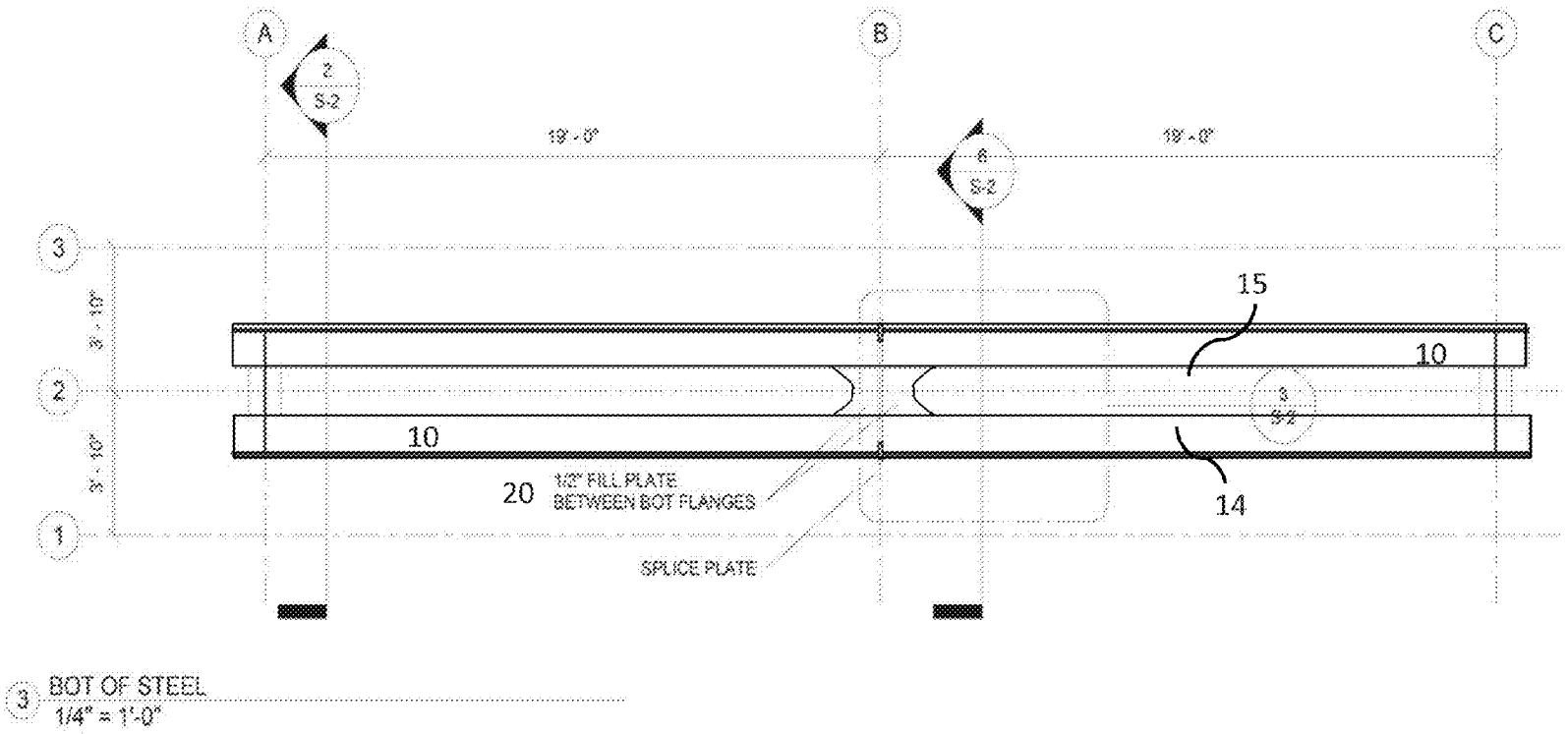
FIG. 12 is a bottom side schematic of two folded plate girders attached by an embodiment of a connection system, according to the subject invention.
Figure 13:
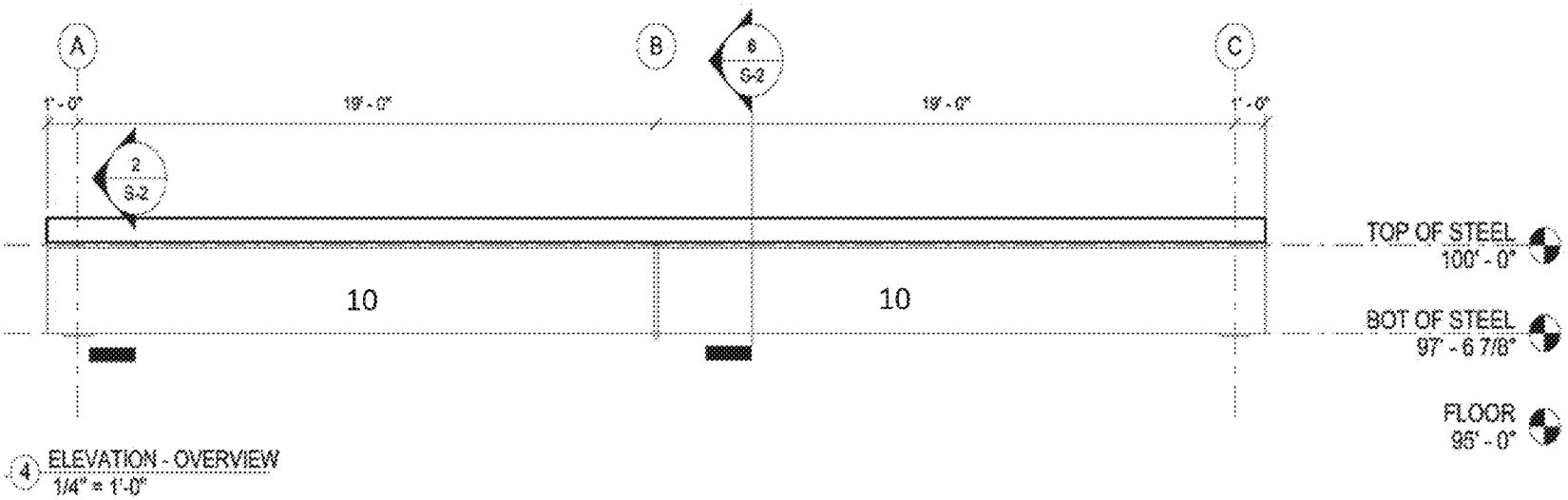
FIG. 13 is a side elevation view of two folded plate girders attached by an embodiment of a connection system, according to the subject invention, with decking arranged on the top ends of the girders.
Figure 14:
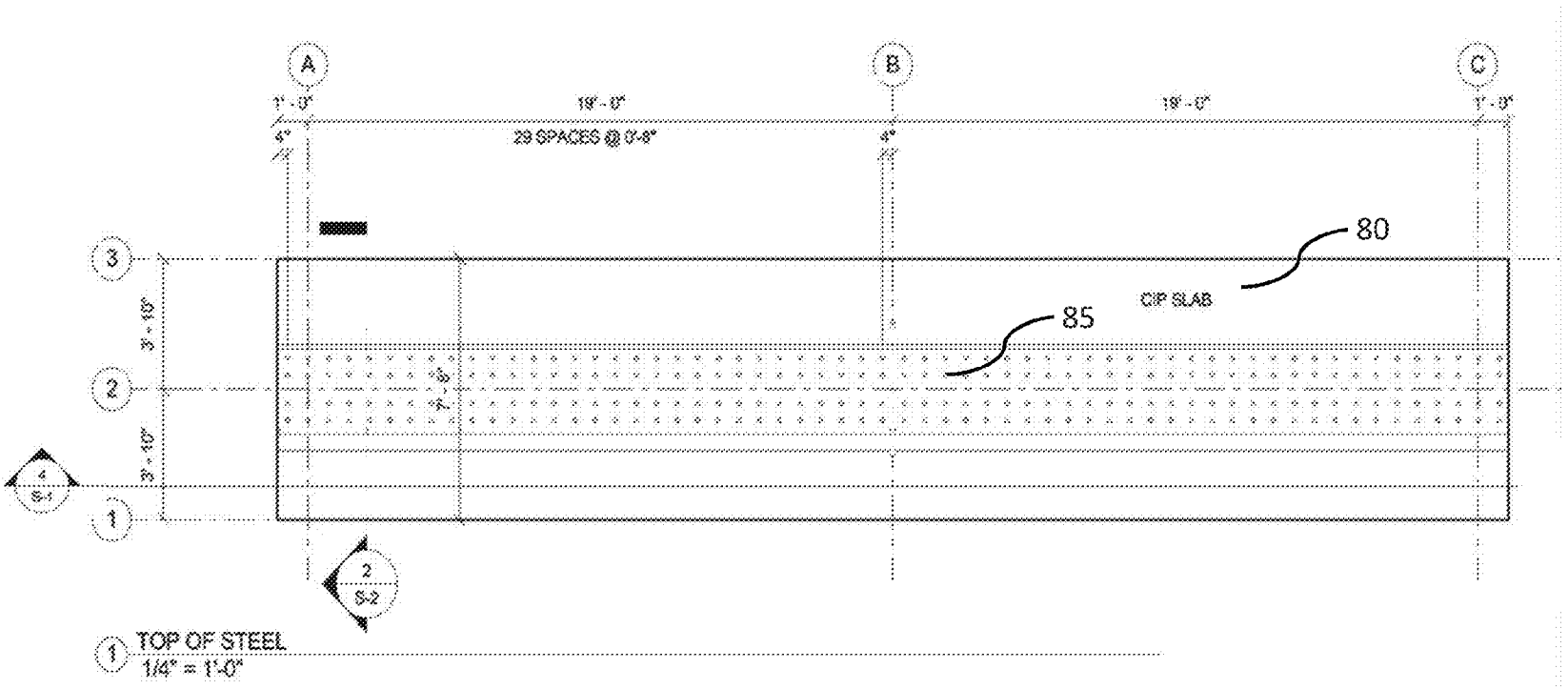
FIG. 14 is a bottom plan view of a folded plate girder, showing the flanges and the channel between the flanges.
Figure 15:
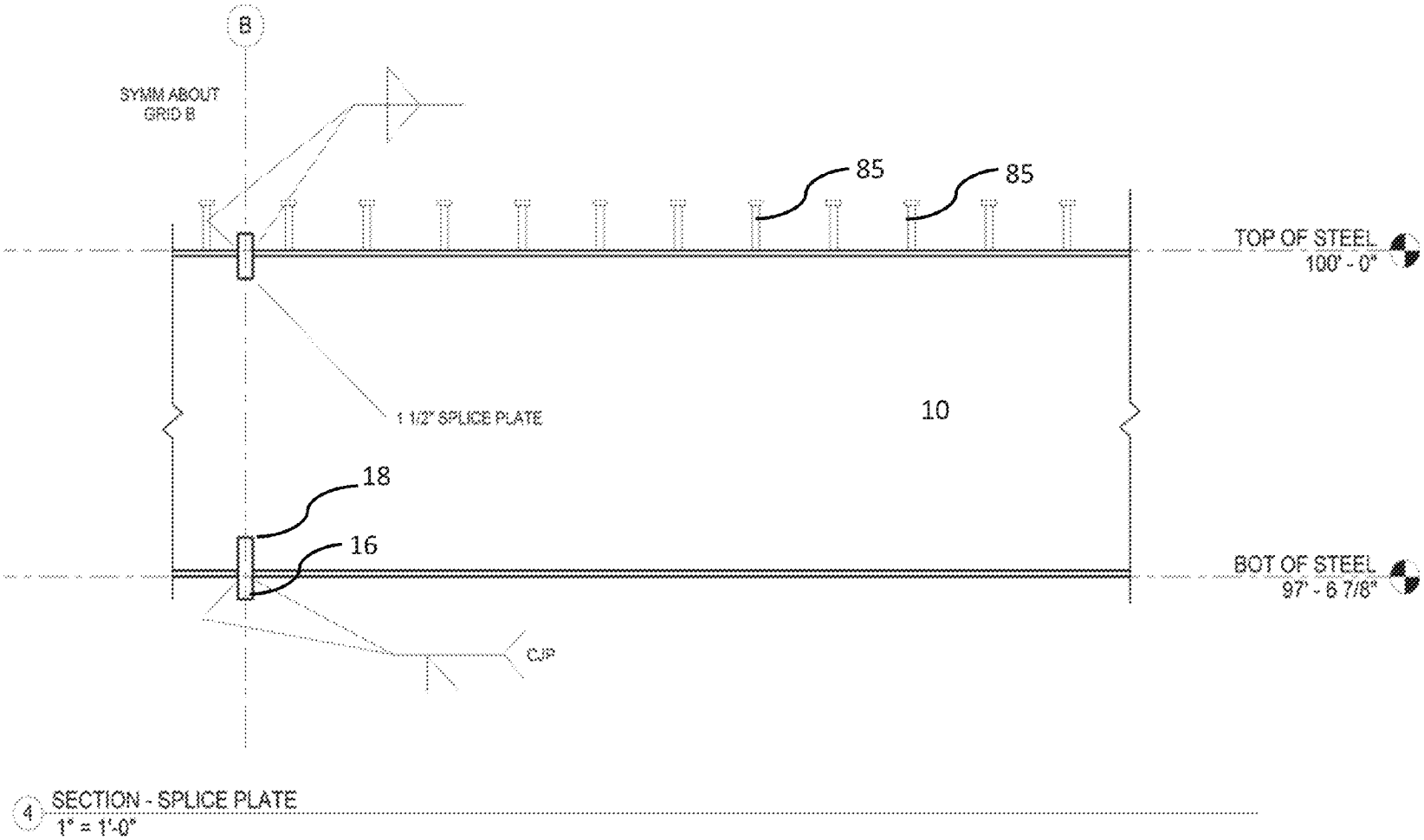
FIG. 15 cross-section taken along a longitudinal length of a folded plate girder with a splice plate.
Figure 16:
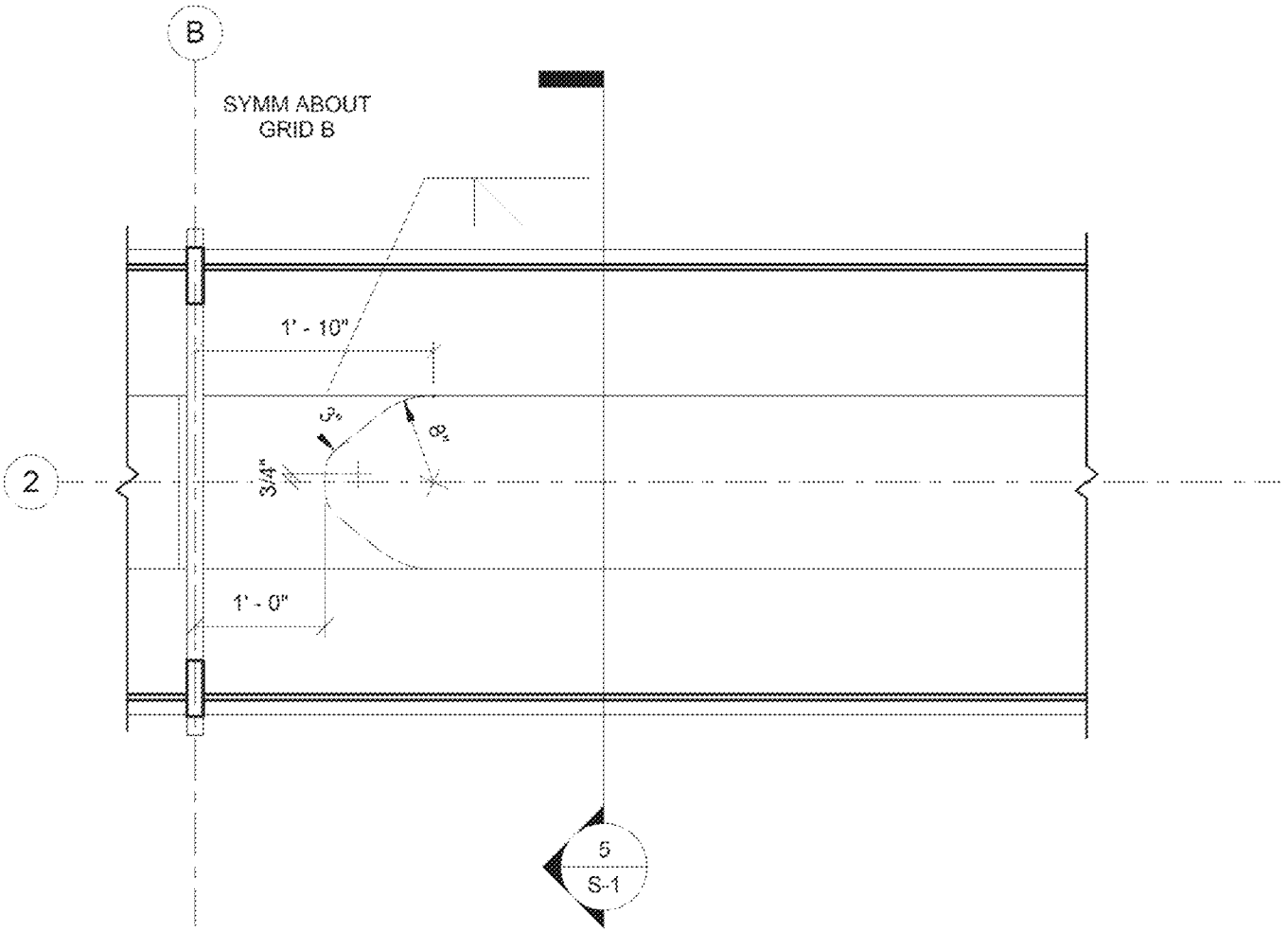
FIG. 16 is partial view of two connected girders, showing one embodiment of a filler plate attached to a splice plate.
Figure 17:
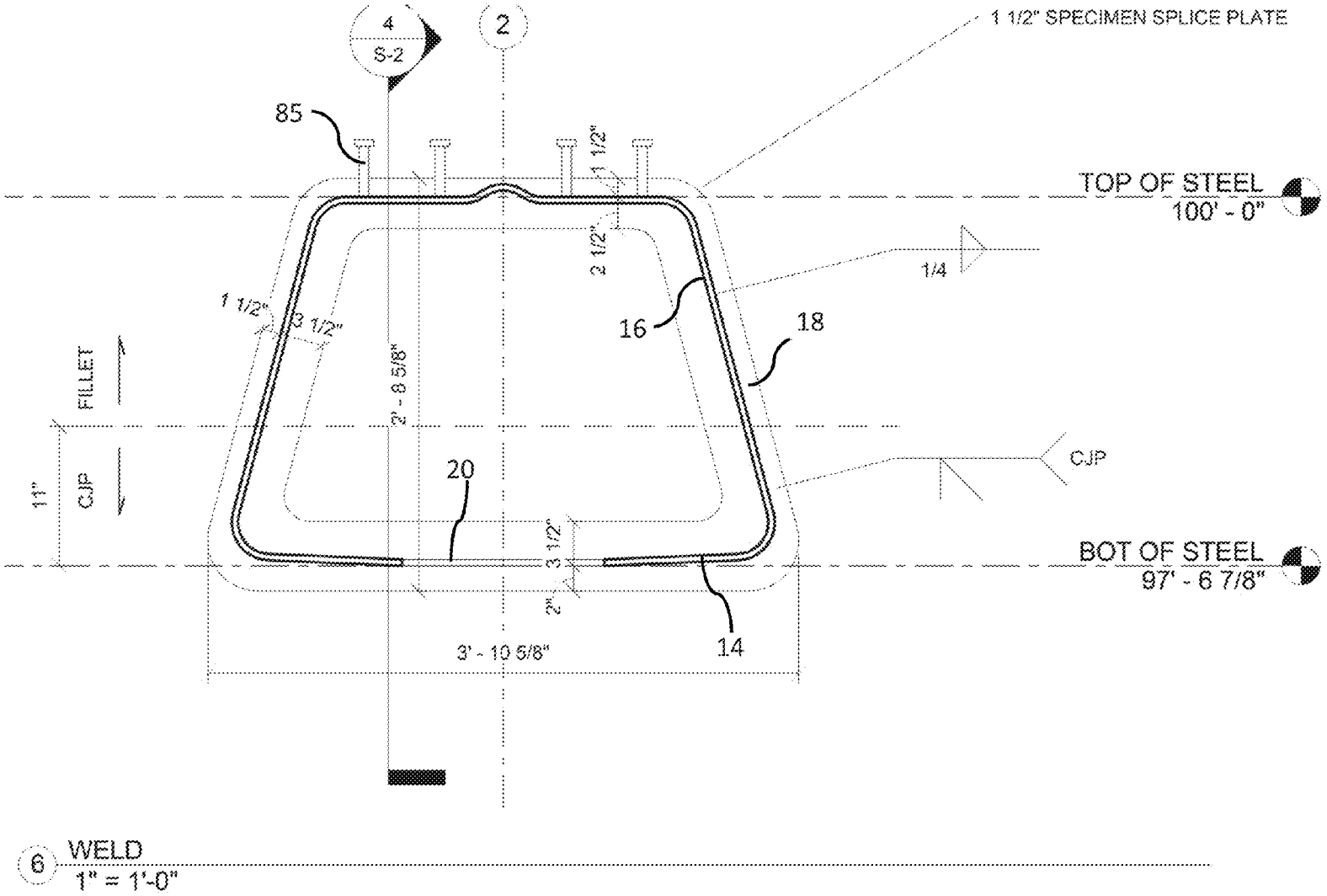
FIG. 17 is a front end plan view of an embodiment of a girder, according to the subject invention, that shows a filler plate in place and shear studs at the top side of the girder.
Figure 18:
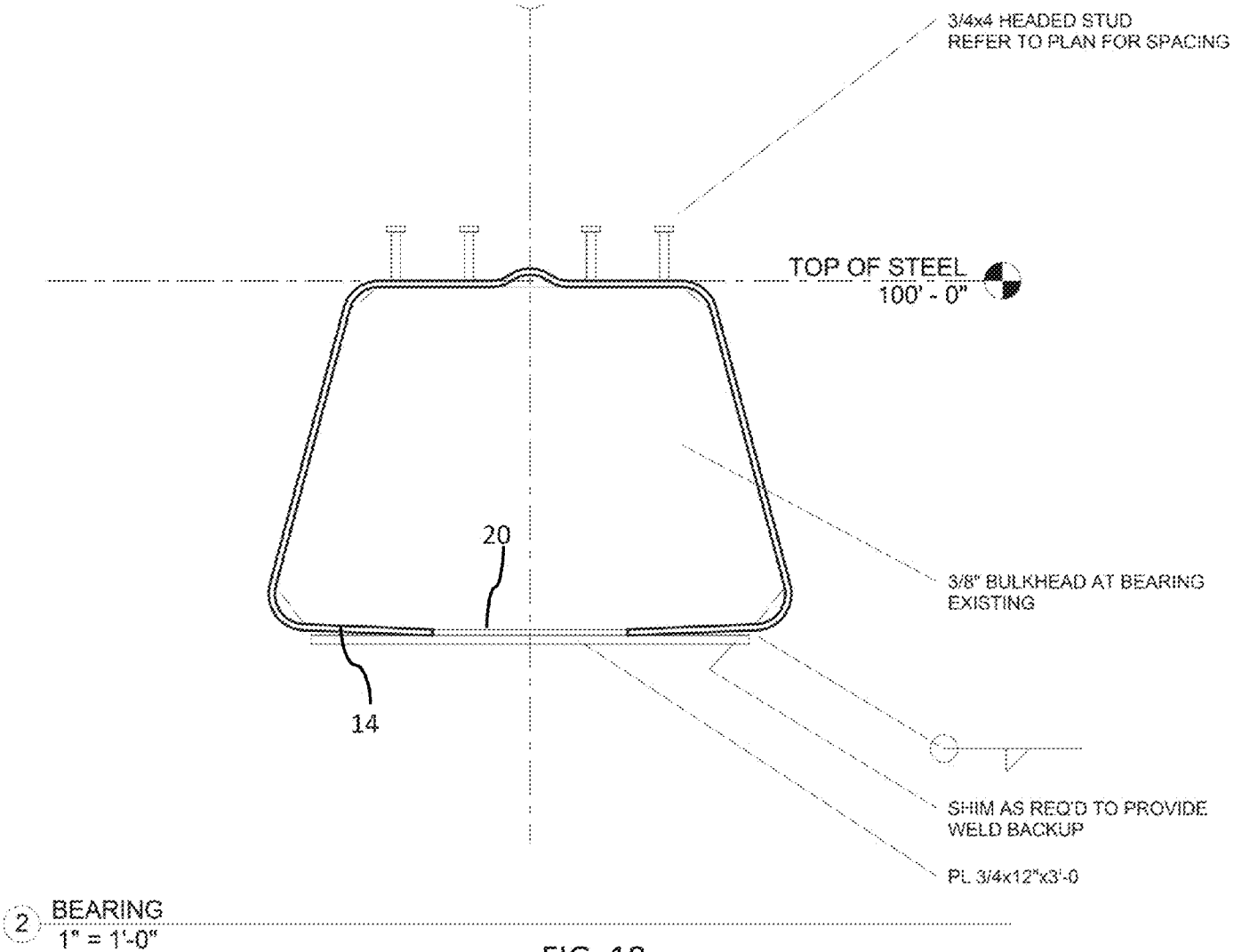
FIG. 18 is cross-section of an embodiment of a girder according to the subject invention, taken just behind the splice plate, showing the position of the filler plate between the flanges.

Example 1: Connector System for Folded Steel Plate Girders for Providing Camber Between the Girders With reference to FIG. 7, folded steel plate girders can be connected as follows:

a) A filler plate (plate A), having a thickness that is greater than the folded plate girder thickness can be welded to the edges of folded plate girder bottom flanges using a full penetration weld. The length of this filler plate can be determined based on design criteria of plastic moment capacity at the cross section where plate ends (section C) and is equal to the yield moment capacity of a cross section at the junction of the folded plate and the splice plate (plate B).

b) Each folded plate girder can be welded to a splice plate (plate B) using a full penetration weld. Here the full penetration weld can be used to impart a slope to the splice plate, so that the top side tilts over the bottom side. This will provide positive camber when girders are connected.

c) Splice plate (Plate B) on each end of each folded plate girder can be bolted together to join two folded plate girders.

d) Splice plate (Plate B) can accommodate the tolerances needed because of the possibility of two folded plate girders having slightly different dimensions.

Folded plate girders are commonly used for bridge spans. Their use is often limited to short span bridges because manufacturing constraints to not allow the incorporation of camber along the length of the girder. The embodiments of the subject invention provide a modification to folded plate girders that allow them to be used on longer bridge spans. By angling the ends of the girders and the addition of a splice plate at the ends of a girder for attaching girders, camber can be formed between girders. The further incorporation of a filler plate between the bottom flanges can aid in reducing areas of stress around the splice plate, which allows a larger span of attached girders. With the subject invention, folded plate girders can be used on larger bridge spans.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

The invention claimed is:

1. A folded plate girder having a bottom side with flanges and a channel therebetween and further comprising a connector system comprising:

a splice plate fixedly attached to a first end face of folded plate girder, wherein the splice plate is attached at an obtuse angle relative to a longitudinal length of the girder;

a filler plate positioned within the channel and fixedly attached to the flanges and the splice plate; such that, when the splice plates of two folded plate girders are connected, a bottom side of the girders forms an obtuse arc.

2. The folded plate girder, according to claim 1, wherein the splice plate is attached to the end face to form an inside flange and an outside flange.

3. The folded plate girder, according to claim 1, further comprising bolt holes in the splice plate.

4. The folded plate girder, according to claim 2, further comprising bolt holes in the outside flange.

5. The folded plate girder, according to claim 4, further comprising bolt holes in the inside flange.

6. The folded plate girder, according to claim 1, wherein the obtuse arc formed between the bottom ends of two connected girders is between about 181° and about 190°.

7. The folded plate girder, according to claim 6, wherein the two connected girders further comprise camber of between approximately 0.5 inches per 40 feet of girder length and approximately 2.0 inches per 40 feet of girder length.

8. The folded plate girder, according to claim 1, further comprising a splice plate attached to a second end face the folded plate girder.

9. A method for attaching folded plate girders to impart camber between the girders, the method comprising:

A. providing at least two folded plate girders having a bottom side with flanges and a channel therebetween and further comprising a connector system comprising, a splice plate fixedly attached to a first end face of folded plate girder, the splice plate being attached at an obtuse angle relative to a longitudinal length of the girder;

a filler plate positioned within the channel and fixedly attached to the flanges and the splice plate; and B. connecting the splice plate on the first end face of one folded plate girder to the splice plate on the first end face of another folded plate girder, such that an obtuse angle is formed between the bottom sides of the connected folded plate girders.

10. The method, according to claim 9, wherein the splice plates are attached to the end faces to form an inside flange and an outside flange.

11. The method, according to claim 9, further comprising bolt holes in the outside flange of the splice plate.

12. The method, according to claim 11, further comprising bolt holes in the inside flange of the splice plate.

13. The method, according to claim 9, wherein the obtuse arc formed between the bottom ends of two connected girders is between about 181° and about 190°.

14. The method, according to claim 13, wherein the two connected girders further comprise camber of between approximately 0.5 inches per 40 feet of girder length and approximately 2.0 inches per 40 feet of girder length.

15. The method, according to claim 9, further comprising a splice plate attached to a second end face of the at least two folded plate girders, wherein the method further comprises:

C. connecting the splice plate on a first end face of another folded girder to the splice plate on the second end face of one of the connected folded plate girders thereby forming another obtuse angle between the bottom sides of one of the previously connected folded plate girders and the other folded plate girder attached thereto; and D. repeating step C until sufficient folded plate girders are attached.

16. A kit for joining folded plate girders comprising:

a folded plate girder having a bottom side with flanges and a channel therebetween and further comprising a connector system comprising:

a splice plate having a plurality of bolt holes and fixedly attached to an end face of folded plate girder, wherein the splice plate is attached at an obtuse angle relative to a longitudinal length of the girder and bolt holes in the splice plate;

a filler plate positioned within the channel and fixedly attached to the flanges and the splice plate; and a plurality of bolts for connecting the splice plate of one folded plate girder to the splice plate of another folded plate girder, such that, when the splice plates of two folded plate girders are connected, a bottom side of the girders forms an obtuse arc.

17. The kit according to claim 16, further comprising a splice plate attached to a second end face of the at least two folded plate girders.

18. The kit according to claim 17, further comprising one or more additional folded plate girders for connecting to the splice plates at the second end of an attached splice plate.

19. The kit, according to claim 18, wherein the obtuse arc formed between the bottom ends of two connected girders is between about 181° and about 190°.

20. The kit, according to claim 18, wherein the two connected girders further comprise camber of between approximately 0.5 inches per 40 feet of girder length and approximately 2.0 inches per 40 feet of girder length.

* * * * *